US009224274B1

(12) United States Patent
Budde et al.

(10) Patent No.: US 9,224,274 B1
(45) Date of Patent: Dec. 29, 2015

(54) SYSTEM AND METHOD FOR FINANCIAL SERVICES DEVICE USAGE

(71) Applicant: JPMorgan Chase Bank, N.A., New York, NY (US)

(72) Inventors: William Budde, Dublin, OH (US); Joseph Bradley Nolan, New Albany, OH (US)

(73) Assignee: JPMorgan Chase Bank, N.A., New York, NY (US)

( * ) Notice: Subject to any disclaimer, the term of this patent is extended or adjusted under 35 U.S.C. 154(b) by 136 days.

(21) Appl. No.: 13/767,422

(22) Filed: Feb. 14, 2013

(51) Int. Cl.
*G07F 19/00* (2006.01)

(52) U.S. Cl.
CPC ..... *G07F 19/201* (2013.01); *G07F 19/21* (2013.01)

(58) Field of Classification Search
USPC ..... 235/379
See application file for complete search history.

(56) References Cited

U.S. PATENT DOCUMENTS

| | | | |
|---|---|---|---|
| 5,901,303 | A | 5/1999 | Chew |
| 6,101,477 | A | 8/2000 | Hohle et al. |
| 6,298,336 | B1 | 10/2001 | Davis et al. |
| 6,405,179 | B1 | 6/2002 | Rebane |
| 6,418,420 | B1 | 7/2002 | DiGiorgio et al. |
| 6,450,407 | B1 | 9/2002 | Freeman et al. |
| 6,549,912 | B1 | 4/2003 | Chen |
| 6,611,819 | B1 | 8/2003 | Oneda |
| 6,776,332 | B2 | 8/2004 | Allen et al. |
| 6,889,198 | B2 | 5/2005 | Kawan |
| 6,892,052 | B2 | 5/2005 | Kotola et al. |
| 7,195,154 | B2 | 3/2007 | Routhenstein |
| 7,506,806 | B2 | 3/2009 | Bonalle et al. |
| 7,584,153 | B2 | 9/2009 | Brown et al. |
| 7,708,198 | B2 | 5/2010 | Gangi |
| 8,540,142 | B1 * | 9/2013 | Lewis et al. ..... 235/379 |
| 2001/0027441 | A1 | 10/2001 | Wankmueller |
| 2002/0062253 | A1 | 5/2002 | Dosh, Jr. et al. |
| 2003/0218066 | A1 | 11/2003 | Fernandes et al. |
| 2004/0029569 | A1 | 2/2004 | Khan et al. |
| 2004/0094624 | A1 | 5/2004 | Fernandes et al. |
| 2004/0159700 | A1 | 8/2004 | Khan et al. |
| 2005/0033688 | A1 | 2/2005 | Peart et al. |
| 2005/0038741 | A1 | 2/2005 | Bonalle et al. |
| 2006/0011719 | A1 | 1/2006 | Lehtonen et al. |
| 2006/0020558 | A1 | 1/2006 | Bonalle et al. |
| 2006/0219776 | A1 | 10/2006 | Finn |
| 2006/0249574 | A1 | 11/2006 | Brown et al. |

(Continued)

OTHER PUBLICATIONS

Consortium created to manage common electronic purse specification, Cardtech Securtech, Chicago, www.visa.com/av/news/PRmisc051199.vhtml, May 11, 1999.

Visa releases visa cash electronic purse specifications based on CEPS, www.visa.com/av/news/PRaamisc042099.vhtml, San Francisco, Apr. 20, 1999.

(Continued)

*Primary Examiner* — Daniel Hess
(74) *Attorney, Agent, or Firm* — Hunton & Williams LLP

(57) ABSTRACT

A system and method is provided to enable a financial services device, such as, for example, an ATM or financial services kiosk, to support a variety of card types. The card may be used for login purposes. The financial services device according to exemplary embodiments may be capable of supporting both magnetic strip only cards and EMV type cards. A card is inserted into a card reader, the card type is determined, and the card is removed. When an EMV card is recognized, the financial services may request the card be reinserted into the card reader whereupon it is clamped and held for the duration of interaction with the financial services device.

12 Claims, 8 Drawing Sheets

(56) References Cited

U.S. PATENT DOCUMENTS

| | | | |
|---|---|---|---|
| 2007/0136211 | A1 | 6/2007 | Brown et al. |
| 2007/0208671 | A1 | 9/2007 | Brown et al. |
| 2009/0240620 | A1 | 9/2009 | Kendrick et al. |
| 2009/0289106 | A1 | 11/2009 | Bishop et al. |
| 2010/0030697 | A1 | 2/2010 | Goodrich et al. |
| 2010/0100480 | A1 | 4/2010 | Altman et al. |

OTHER PUBLICATIONS

Proton world and Europay to co-operate in creation of new CEPS-compliant e-purse application, Press Release 1999, Waterloo, Belgium, Jun. 28, 1999, 2 pages.

Vandenengel, G., Cards on the Internet Advertising on a $3 Bill, Industry Intelligence, Feb. 1, 1995, pp. 46-48.

Fleishman, D., et al., The Federal Transit Administration, TCRP Report 32 Multipurpose Transit Payment Media, Chapter 2 Multipurpose Fare Payment Overview, p. 10-20, 1998.

Allen, C., et al., Overview of Smart Cards and the Industry, Smart Cards Seizing Strategic Business Opportunities, Chapter 1, pp. 2-20, Irwin Professional Publishing, 1997.

Davis, D., Merchants Unbound, Card Technology, Jun. 2004, vol. 9, No. 7, p. 36 (8 pages).

ViVotech, Inc., RF-Based Contactless Payment a More Convenient Way to Pay, White Paper—Version 2.0, Apr. 2004.

EMVCo, A Guide to EMV, Version 1.0, May 2011, pp. 1-34.

* cited by examiner

400

500

SYSTEM AND METHOD FOR FINANCIAL SERVICES DEVICE USAGE

Exemplary embodiments relate generally to providing financial services, such as through devices such as financial services kiosks and Automated Teller Machines.

BACKGROUND

EMV stands for Europay, MasterCard, and Visa. It represents a standard for inter-operation of integrated circuit cards (also known as chip cards). There are a number of chip cards implementations in use. Many of these implementations include a magnetic stripe on the backside of the card. While these cards are widely used around the world, such as in Europe, at the present, the cards are not widely used in the United States. Thus, many devices, such as Automated Teller Machines, in the United States are not capable of interacting with an EMV card.

These and other deficiencies exist.

SUMMARY OF THE PREFERRED EMBODIMENTS

An exemplary embodiment includes a computer implemented method, having the steps of: reading, electronically by a card reader, information from a magnetic stripe associated with a card at a financial transaction device; and processing the information to determine a type of the card. The method may further include the card being inserted into the card reader and then withdrawn. The method may further include: determining that the card is an EMV card; providing, electronically, a message that requests the card be reinserted into the card reader; and upon reinsertion of the card, clamping the card into the card reader for a time during which a transaction is conducted at the financial transaction device. The method may also include: determining that the card is a magnetic stripe only card, and wherein the card is not required to be reinserted during a transaction conducted at the financial transaction device.

Another exemplary embodiment includes a computer implemented method having the steps of: receiving, electronically, indication of an insertion of a card into a card reader associated with a financial transaction device; upon detection of the insertion, clamping the card by the card reader such that the card cannot be removed; reading, electronically by the card reader, information from a magnetic stripe associated with the card; and processing the information to determine a type of the card. The method may further include: determining that the card is an EMV card; and maintaining the clamping on the card for a time during which a transaction is conducted at the financial transaction device. The method may also include: determining that the card is a magnetic stripe only card, and releasing the clamping on the card; and providing, electronically, a message that requests the card be withdrawn from the card reader.

In other exemplary embodiments, the preceding methods may be performed using a system with a processor and a memory comprising computer-readable instructions which when executed by the processor cause the processor to perform the method steps.

These and other embodiments and advantages of the invention will become apparent from the following detailed description, taken in conjunction with the accompanying drawings, illustrating by way of example the principles of the various exemplary embodiments.

DETAILED DESCRIPTION OF THE PREFERRED EMBODIMENTS

Figure 1:
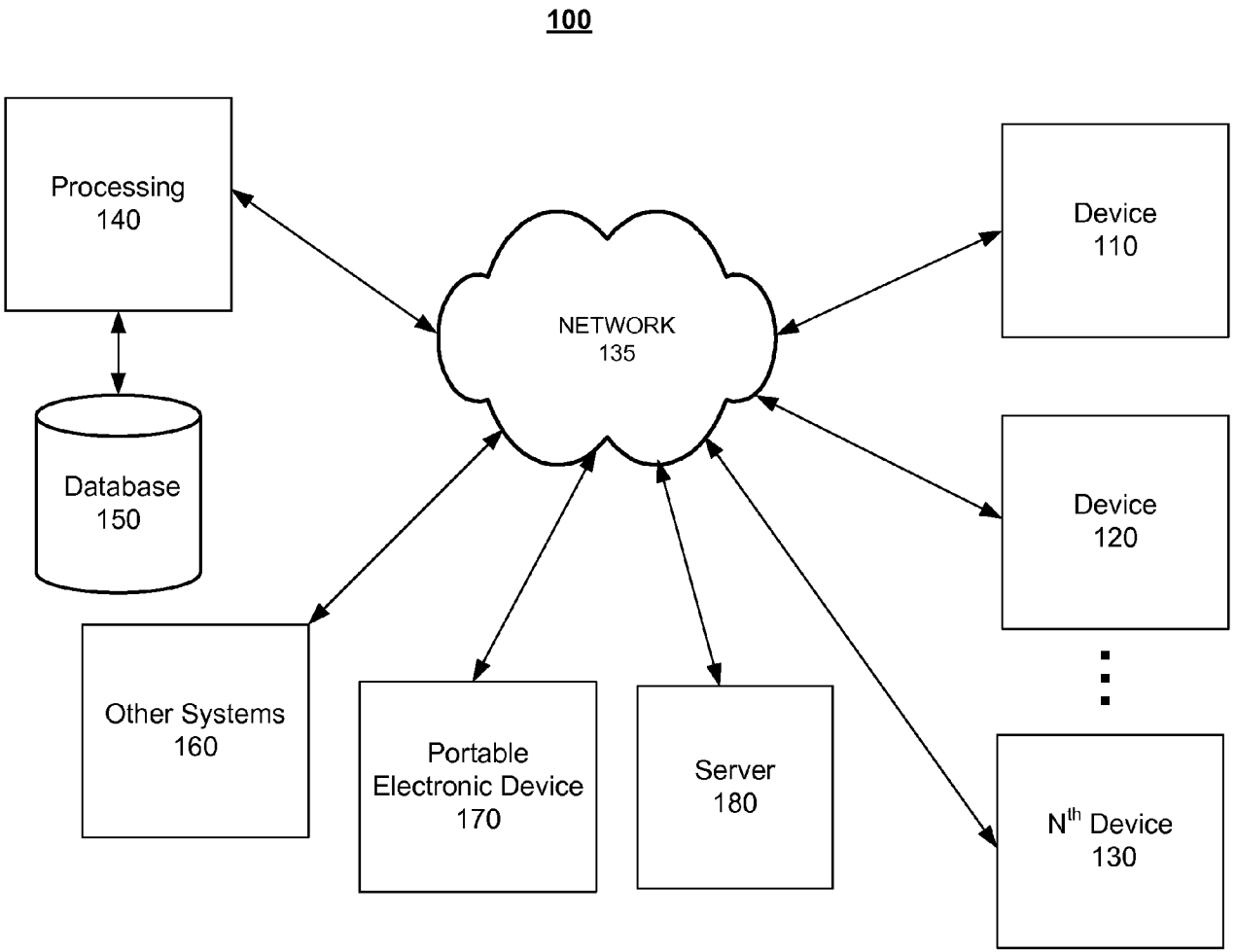
FIG. 1 is a diagram of a system in accordance with an exemplary embodiment.

It will be readily understood by those persons skilled in the art that the embodiments of the inventions described herein are capable of broad utility and application.

Accordingly, while the invention is described herein in detail in relation to the exemplary embodiments, it is to be understood that this disclosure is illustrative and exemplary of embodiments of the invention are described to provide an enabling disclosure of the invention. Accordingly, the disclosure is not intended to be construed to limit the embodiments of the invention or otherwise to exclude any other such embodiments, adaptations, variations, modifications and equivalent arrangements. While the various embodiments of the present invention are described in the context of financial transaction/services devices and providing of financial service through such devices, the methods and systems described herein may be applied to other related services involving interaction with similar devices.

The following descriptions are provided of different configurations and features according to exemplary embodiments. These configurations and features may relate to providing financial services through financial services devices. While certain nomenclature and types of applications/hardware are described, other names and application/hardware usage is possible and the nomenclature provided is done so by way of non-limiting examples only. Further while particular embodiments are described, it should be appreciated that the features and functions of each embodiment may be combined in any combination as is within the capability of one of ordinary skill in the art. The attached Figures provide additional details regarding the present invention. It should also be appreciated that these exemplary embodiments are provided as non-limiting examples only.

Financial services devices, as used herein, may include machines, kiosks, and stations for performing financial services transactions. These devices include, but are not limited to, automated teller machines ("ATMs"), personal teller machines ("PTMs"), financial self-service devices, financial services kiosks, financial transaction devices, portable electronic devices, money machines, cash machines, bank machines, and bancomats.

According to exemplary embodiments, a system and method may be provided to allow a customer to use an EMV card, in addition to a more traditional magnetic stripe card, at a financial transaction device. The card of either type may be used to perform the login process to the financial transaction device. The financial transaction device may be capable of accommodating traditional ATM cards that employ a magnetic stripe and also may support cardless login methods, such as Near Field Communications (NFC) and Bluetooth and other wireless technologies. According to exemplary embodiments, the financial transaction device may support EMV type cards. Accordingly, the financial transaction device according to exemplary embodiments is capable of supporting the use of a variety of login and card types.

According to exemplary embodiments, the customer may first dip or otherwise insert their card into a reader at the financial transaction device and then remove the card. Information may be read, by the card reader, from the card from the magnetic stripe on the back of the card. From this information, the financial transaction device may determine that the type of card. If the card is a card type that has only a magnetic stripe (that is, a non-EMV card), then the transaction may continue without the need for additional interaction with the card. However, if the card is recognized as an EMV card based on the data that is read, then the customer is instructed to reinsert the card into the reader. The card reader then clamps or otherwise secures the EMV card for the duration of the transaction. During a transaction using an EMV card, the card is held in place to allow the reader to interface with the card's chip and allow data to be exchanged with the chip in the card.

In some embodiments, if the customer understands the need to leave the EMV card in the reader during the transaction, the EMV card may be left in the reader. Upon determination of the card type, the financial transaction device may clamp on the card and establish a connection therewith without the customer being required to remove and reinsert the card.

In other embodiments, the financial transaction device may be configured to clamp and hold all inserted cards during the first interaction. Thus, no removal of the card is required (and removal is not possible until the card type is determined). Upon determination that the card is a magnetic stripe only card, the customer may be allowed to remove the card for the remainder of the transaction. Instructions may be provided to the customer alerting them as to when card removal is possible. In some embodiments, the clamping may occur after the card is left in the financial transaction device for a period of time. The period of time may be a short period of time. For example, the time may be a couple of seconds.

The logic herein described may be implemented by hardware, software, and/or a combination of the two. In embodiments where the logic is implemented using software, upgrades and other changes may be performed without hardware changes. The software may be embodied in a non-transitory computer readable medium.

FIG. 1 is a system according to an exemplary embodiment of the invention. System 100 may provide various functionality and features associated with the program. More specifically, system 100 may include a device 110, a second device 120, and an Nth device 130, a network 135, a processing module 140, a database 150, other systems 160, a portable electronic device 170, and a server 180. While a single illustrative block, module or component is shown, these illustrative blocks, modules or components may be multiplied for various applications or different application environments. In addition, the modules or components may be further combined into a consolidated unit. The modules and/or components may be further duplicated, combined and/or separated across multiple systems at local and/or remote locations. For example, some of the modules or functionality associated with the modules may be supported by a separate application or platform. Other implementations and architectures may be realized. It should be appreciated that system 100 may be integrated into and run on a computer, which may include a programmed processing machine which has one or more processors. Such a processing machine may execute instructions stored in a memory to process the data. System 100 may be integrated into and run on one or more computer networks which may each have one of more computers associated therewith.

As noted above, the processing machine executes the instructions that are stored in the memory or memories or persistent or non-transitory data storage devices to process data. This processing of data may be in response to commands by a user or users of the processing machine, in response to previous processing, in response to a request by another processing machine and/or any other input, for example. As described herein, a module performing functionality may have a processor.

According to exemplary embodiments, the system 100 may be configured to carry out the methods as described herein. The system 100 may have device 110 associated therewith. A second device 120 and an Nth device 130 may be further associated with the system 100. The devices 110, 120, and 130 may each be a processing machine. Each device 110, 120, and 130 may include software and/or modules to implement the methods described herein according to exemplary embodiments. Each device 110, 120, and 130 may provide processing, display, storage, communications, and execution of commands in response to inputs from a user thereof and respond to requests from the software and/or modules.

The devices 110, 120, and 130 may each serve as a client side. Each device 110, 120, and 130 may be a "fat" client, such that the majority of the processing may be performed on the client. Alternatively, the device 110, 120, and 130 may each be a "thin" client, such that the majority of the processing may be performed in the other components of the system 100 as shown in FIG. 1. The devices 110, 120, and 130 may be configured to perform other functions and processing beyond the methods described herein. The devices 110, 120, and 130 may each be a part of a larger system associated with the financial institution. The devices 110, 120, and 130 may be multi-functional in operation.

Each device 110, 120, and 130 may have a display and an input device associated therewith. The display may be monochrome or color. For example, the display may be a plasma, liquid crystal, or cathode ray tube type display. The displays may be touch screen type displays. The devices 110, 120, and 130 may have more than one display. The multiple displays may be different types of displays. The display may have sub-displays there on. For example, the device 110, 120 and 130 may have a large display surface. The display for the user interface may occupy a portion or less than the whole of the large display surface.

The input device may be a single device or a combination of input devices. For example, the input devices may include a keyboard, both full-sized QWERTY and condensed, a numeric pad, an alpha-numeric pad, a track ball, a touch pad, a mouse, selection buttons, and/or a touch screen. As described above, the display may serve as an input device through using or incorporating a touch screen interface. The devices 110, 120, and 130 may include other devices such as a printer and a device for accepting deposits and/or dispensing currency and coins.

The device 110, 120, and 130 may have one or more cameras, optical sensors, or other sensing devices. The sensors may be computer controlled and may capture digital images.

According to some embodiments, the devices 110, 120, and 130 may be financial services devices as described herein. The financial services device may be a transaction device for conducting transactions with the financial institution. For example, the devices 110, 120, and 130 may each be an ATM. In other embodiments, the devices 110, 120, and 130 may each be financial services kiosks. In some embodiments, the devices 110, 120, and 130 may be a portable or hand-held computing or electronic devices, or other types of computing devices, that has the described functionality. For example, the devices 110, 120, and 130 may be tablet computing devices. The tablet computing device may be used to perform transactions similar or the same as those at a traditional ATM as described herein. Additional devices may be coupled to the portable or hand-held computing device to perform various functions such as accepting deposits or dispensing currency.

The devices 110, 120, and 130 may provide various functionality and features for conducting transactions with the financial institution. Accordingly, the devices 110, 120, and 130 may be referred to as financial transaction devices. For example, the devices 110, 120, and 130 may be capable of accepting deposits and mixed deposits, withdrawals and multi-denomination withdrawals, coin deposits/withdrawal, check cashing, statement printing, wires, bill pay and check printing. It should be appreciated that the devices 110, 120, and 130 may be capable of other functions and features. Transactions may be supported relating to other financial institutions. For example, the device may be part of a network associated with more than one financial institution. The network may be managed by a third party.

The devices 110, 120, and 130 may have a log-in device associated therewith. The log-in device may be used to allow access to the device. The log-in device may require a particular input or it may accept a combination of inputs. The input may serve as an authentication of the user to the device 110, 120, or 130 and the system 100 in general. Various authentication or log-on systems and methods may be used. For example, these methods and systems may include entering a password or PIN (Personal Identification Number) or using a card to log-on, either via swiping the card through a reader, such as a magnetic stripe reader or a smart chip reader, or through a radio frequency system (which may require that the card be placed in proximity to an appropriate reader (i.e., a contactless system), such as RFID (Radio Frequency Identification) or NFC (Near Field Communications). For example, the Blink® system may be used. It should be appreciated that the card may include a combination of a magnetic stripe, a smart chip, and radio frequency. Further, the use of the card is exemplary only and the card may include fobs, stickers, and other devices. Biometrics may be used, such as fingerprints, facial recognition, speech recognition, or retinal scan. A combination of these systems may be used. Biometrics may be used in addition to other log-in methods and systems.

The devices 110, 120, and 130 may be communicatively coupled to a network 135. Accordingly, the devices 110, 120, and 130 may be geographically dispersed. Conversely, two or more of devices 110, 120, and 130 may be located in close proximity to provide a cluster of devices for customer use. For example, the devices may be located within or near a branch office of the financial institution. The devices may be located in other locations such as retailers or merchants. Network 135 may be a computer based network, with one or more servers and/or computer processors. For example, network 135 may be the Internet or a network connected to the Internet. The network 135 may be a satellite or cellular based network. Information and data may be exchanged through the network 135 between the various components of the system 100. In alternative embodiments, the network 135 may be a local area network within the financial institution that may be connected to or interface with the Internet. It should be appreciated that the network 135 may be a combination of local area networks, wide area networks, and external networks, which may be connected to the Internet.

The processing module 140 may be communicatively coupled to the network 135. The processing module 140 may perform operations associated with the establishment, configuration, and application of the programs accordingly to exemplary embodiments. The processing module 140 may consist of one or more servers and/or general purpose computers, each having one or more computer processors associated therewith.

The processing module 140 may have a database 150 communicatively coupled thereto. The database 150 may contain data and information used by the system 100. For example, the database 150 may store account data for financial institution account holders. Additional information maybe contained therein related to the operation and administration of the system 100. The database 150 may include any suitable data structure to maintain the information and allow access and retrieval of the information. For example, the database may keep the data in an organized fashion. The database 150 may be a database, such as an Oracle database, a Microsoft SQL Server database, a DB2 database, a MySQL database, a Sybase database, an object oriented database, a hierarchical database, a flat database, and/or another type of database as may be known in the art that may be used to store and organize rule data as described herein.

The database 150 may be stored in any suitable storage device. The storage device may include multiple data storage devices. The multiple data storage devices may be operatively associated with the database 150. The storage may be local, remote, or a combination thereof with respect to the database. The database 150 may utilize a redundant array of disks (RAID), striped disks, hot spare disks, tape, disk, or other computer accessible storage. In one or more embodiments, the storage may be a storage area network (SAN), an internet small computer systems interface (iSCSI) SAN, a Fiber Channel SAN, a common Internet File System (CIFS), network attached storage (NAS), or a network file system (NFS). The database may have back-up capability built-in. Communications with the database 150 may be over a network, such as the network 135, or communications may be over a direct connection between the database 150 and the processing module 140, as depicted in FIG. 1. Data may be transmitted and/or received from the database 150. Data transmission and receipt may utilize cabled network or telecom connections such as an Ethernet RJ15/Category 5 Ethernet connection, a fiber connection, a traditional phone wireline connection, a cable connection or other wired network connection. A wireless network may be used for the transmission and receipt of data.

The system 100 may have other systems 160 associated therewith. These other systems 160 may include various data collection and support systems used by the financial institution to carry out a variety of functions.

The system 100 may include a portable electronic device or mobile device 170. The portable electronic device 170 may be more than one portable electronic device. The portable electronic device 170 may be associated with a customer. The customer may interact with the portable electronic device through various input means (not shown). For example, the portable electronic device 170 may have a display screen to convey information to the customer. The display may be a color display. For example, the display may be a Liquid Crystal Display ("LCD"). The portable electronic device 170 may have one or more input devices associated with it. For example, the portable electronic device 170 may have an alpha-numeric keyboard, either physical or virtual, for receiving input. The portable electronic device 170 may have a QWERTY style keyboard, either physical or virtual. The portable electronic device 170 may have a pointing device associated therewith, such as, for example, a trackball or track wheel. As described above, the portable electronic device 170 may have communication capabilities over both cellular and wireless type networks to transmit/receive data and/or voice communications.

The portable electronic device 170, by way of non-limiting examples, may include such portable computing and communications devices as mobile phones (e.g., cell or cellular phones), smart phones (e.g., iPhones, Android based phones, or Blackberry devices), personal digital assistants (PDAs) (e.g., Palm devices), laptops, netbooks, tablets, or other portable computing devices. These portable electronic devices may communicate and/or transmit/receive data over a wireless signal. The wireless signal may consist of Bluetooth, Wireless Application Protocol (WAP), Multimedia Messaging Service (MMS), Enhanced Messaging Service (EMS), Short Message Service (SMS), Global System for Mobile Communications (GSM) based systems, Code Division Multiple Access (CDMA) based systems, Transmission Control Protocol/Internet (TCP/IP) Protocols, or other protocols and/or systems suitable for transmitting and receiving data from the portable electronic device. The portable electronic device may use standard wireless protocols which may include IEEE 802.11a, 802.11b, 802.11g, and 802.11n. Such portable electronic devices may be Global Positioning System (GPS) capable. GPS is a satellite based system which sends a signal allowing a device to define its approximate position in a coordinate system on the earth. That is, the portable electronic device may receive satellite positioning data and display the location on the earth of the portable electronic device using GPS. Other location systems may be used. The portable electronic device 170 may include one or more computer processors and be capable of being programmed to execute certain tasks.

The portable electronic device 170 may establish communications with a server 180. Communications may be established over the network 135. Upon successful initiation of communications between the portable electronic device 170 and the server 180, data may be exchanged between the device 170 and the server 180. Data may be transmitted from the portable electronic device 170 to the server 180. Data may be transmitted from the server 180 to the portable electronic device 170.

According to some embodiments, the portable electronic device 170 may interact with the devices 110, 120, or 130. Through the device 110, 120, or 130, the portable electronic device 170 may interact with the server 180 or other parts of the system 100. That is, the device 110, 120, or 130 may serve as an access point to the system 100 for the portable electronic device 170. For example, a user may conduct one or more transactions with the device 110, 120, or 130 using the portable electronic device 170.

It should be appreciated that the server may interact with other parts of the system 100, such as the devices 110, 120, and 130, as well as the processing module 140 and the other systems 160. The server 180 may be a single server or it may be multiple servers. The server 180 may server a variety of roles in the system 100.

The server 180 may have one or more storage devices associated therewith. The storage may be local, remote, or a combination thereof with respect to the server 180. The storage may utilize a redundant array of disks (RAID), striped disks, hot spare disks, tape, disk, or other computer accessible storage. In one or more embodiments, the storage may be a storage area network (SAN), an Internet small computer systems interface (iSCSI) SAN, a Fiber Channel SAN, a common Internet File System (CIFS), network attached storage (NAS), or a network file system (NFS). The storage may have back-up capability built-in. The back-up capability of the storage may be used to archive image data for later use. The back-up capability may be used for recovery of data in the event of a failure of the storage.

Figure 2:
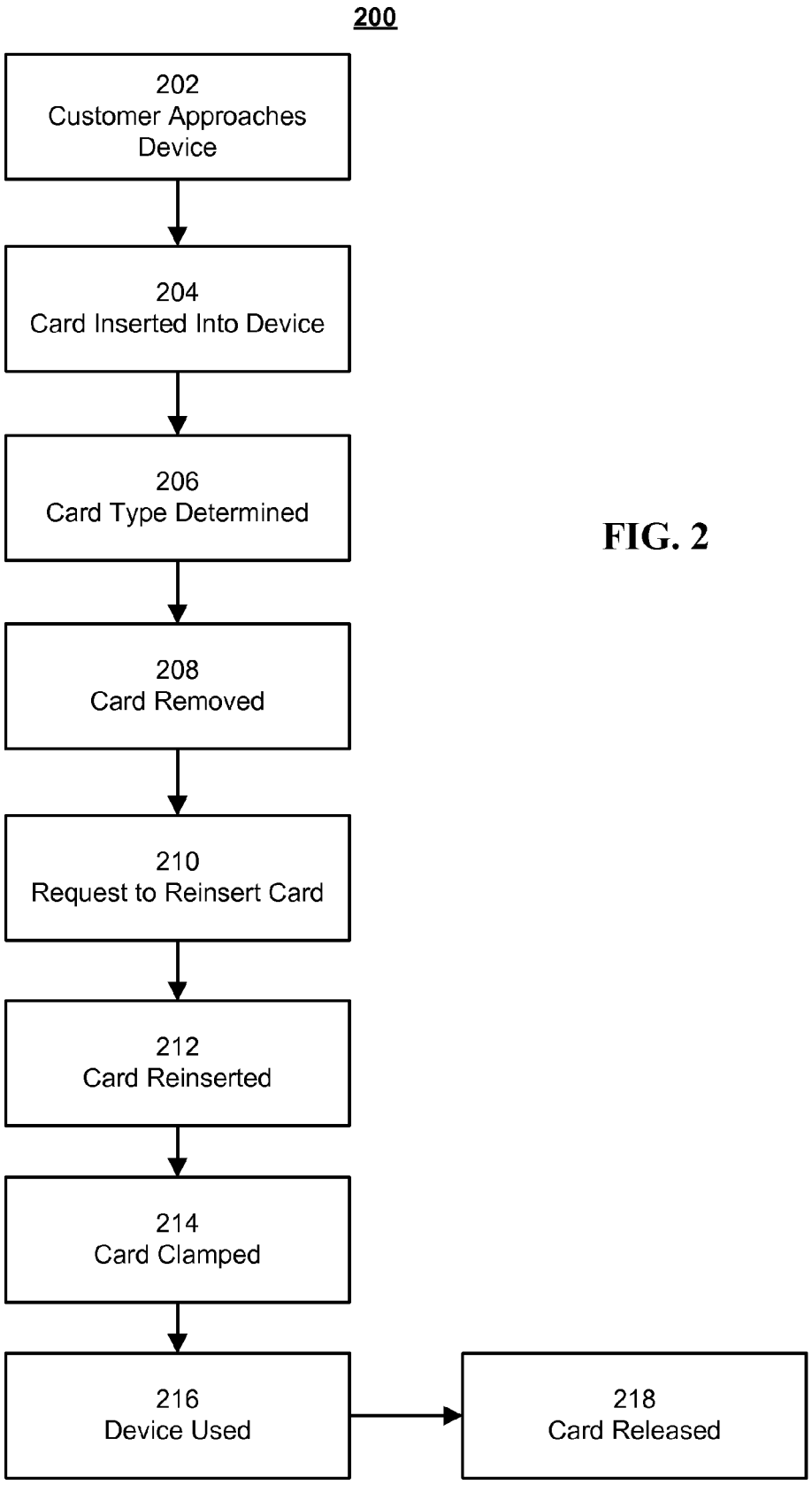
FIG. 2 is a flow chart of a method of interfacing with a financial services device in accordance with an exemplary embodiment.

FIG. 2 depicts a flow chart of a method of interfacing with a financial services device according to exemplary embodiments of the invention. Exemplary method 200 is provided by way of example, as there are a variety of ways to carry out the methods disclosed herein. The method 200 as shown in FIG. 2 may be executed or otherwise performed by one or a combination of various systems, such as a computer implemented system. Each block shown in FIG. 2 represents one or more processes, methods, and/or subroutines carried out in the exemplary method 200. Each block may have an associated processing machine or the blocks depicted may be carried out through one processor machine.

Referring to FIG. 2, at block 202, a customer approaches a device. The device may be a financial services device, a financial services kiosk, or an ATM for example. The device, according to exemplary embodiments, may have a display area located in the front portion of the device. The display area may be used to display information for the customer. The device may have more than one display and the more than one displays may have different sizes. The display may be a touch screen type display such that the customer may interact with the display through the use of their fingers. It should be appreciated that the device may be any type of computer device or terminal with which the customer may interact. For example, the device may be a large touch screen display or a tablet computing device.

The device may be located in or near a branch office of a financial institution which may include banks, credit unions, etc. The device may be located at a retailer or merchant. For example, a financial institution may have an agreement with a merchant to allow a financial services kiosk according to exemplary embodiments to be located near or within a merchant's location. The customer may have one or more accounts with the financial institution. It should be appreciated that the customer may be associated with a different financial institution but may still be able to use the device.

At block 204, a card is inserted into a card reader at the device. The customer may perform this insertion. This insertion may be required to begin interaction, such as a login, with the device in order to conduct a transaction. The login may require the insertion of a card into the card reader. It should be understood that there are a variety of ways to log into the device and many of these login methods are cardless. However, embodiments described herein will focus on the use of a card. The financial transaction device as described above may be capable of supporting by card and cardless type logins using different systems and methods.

At block 206, the type of card is determined. The card may be determined to be either a magnetic stripe only card or a EMV card. The determination is made based on information read from the magnetic stripe of the card.

At block 208, the card is removed from the card reader. The card may be removed from the customer. The initial insertion at block 204 may include the card being slid into the card reader and then removed. This enables the magnetic strip to be read by the card reader. This process may be referred to as dipping the card.

At block 210, upon a determination that a EMV card was inserted, the card is requested to be reinserted. The request may be made using a visual message displayed on the device. An audible message may be used in addition to or in place of the visual message. If the card was a non-EMV card, then the method would go to block 216 directly.

At block 212, the card is reinserted into the card reader. This may be referred to as a double dip of the card.

At block 214, the card reader clamps the card. The clamping is performed to allow contact with the card's chip to be initiated and maintained throughout the interaction with the device.

At block 216, the device is used. The customer may use the device. The device may be used through a set of menu options for performing various actions. For example, the customer may use the device to conduct one or more financial transactions, such as, but not limited to, a deposit or cash withdrawal. A variety of other transactions may be performed as appreciated by one of ordinary skill in the art.

At block 218, the device is logged out of or an indication is made that no further transactions are desired. The customer may indicate that he or she wished to conduct more transactions. The card is released upon log out and/or termination of the transaction. The customer may be presented with a message that the card can be removed. The message may be visual and/or audible.

It should be appreciated that the customer may continue to conduct one or more further transactions prior to logging out of the device. In the event of further transactions, the method 200 may be repeated from block 216 above.

Figure 3:
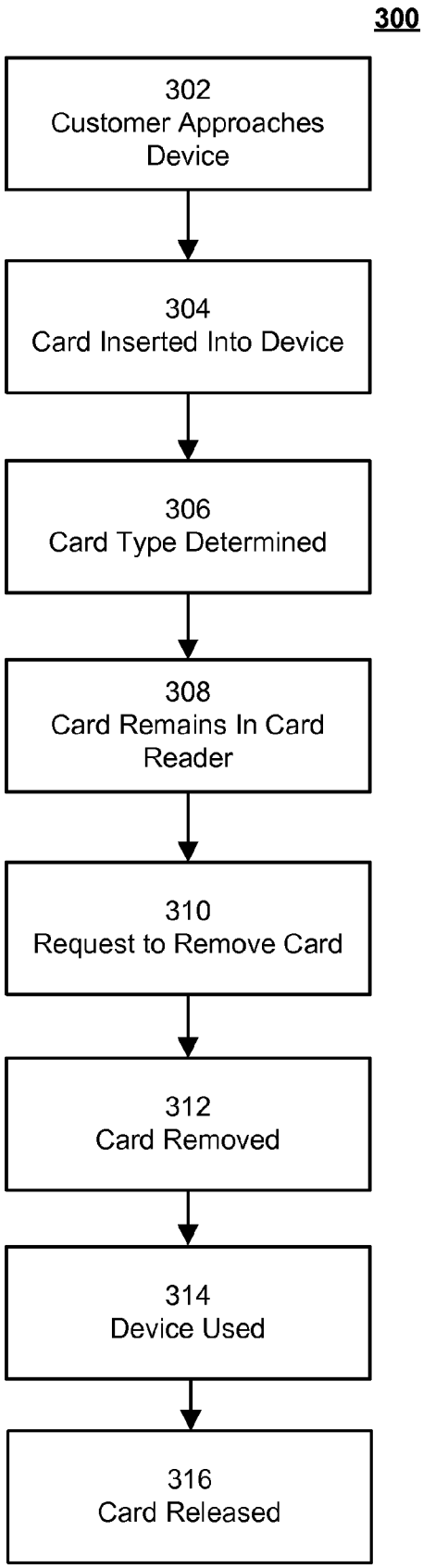
FIG. 3 is a flow chart of a method of interfacing with a financial services device in accordance with an exemplary embodiment.

FIG. 3 depicts a flow chart of a method of interfacing with a financial services device according to exemplary embodiments of the invention. Exemplary method 300 is provided by way of example, as there are a variety of ways to carry out the methods disclosed herein. The method 300 as shown in FIG. 3 may be executed or otherwise performed by one or a combination of various systems, such as a computer implemented system. Each block shown in FIG. 3 represents one or more processes, methods, and/or subroutines carried out in the exemplary method 300. Each block may have an associated processing machine or the blocks depicted may be carried out through one processor machine.

Referring to FIG. 3, at block 302, a customer approaches a device. The device may be a financial services device, a financial services kiosk, or an ATM for example. The device, according to exemplary embodiments, may have a display area located in the front portion of the device. The display area may be used to display information for the customer. The device may have more than one display and the more than one displays may have different sizes. The display may be a touch screen type display such that the customer may interact with the display through the use of their fingers. It should be appreciated that the device may be any type of computer device or terminal with which the customer may interact. For example, the device may be a large touch screen display or a tablet computing device.

The device may be located in or near a branch office of a financial institution which may include banks, credit unions, etc. The device may be located at a retailer or merchant. For example, a financial institution may have an agreement with a merchant to allow a financial services kiosk according to exemplary embodiments to be located near or within a merchant's location. The customer may have one or more accounts with the financial institution. It should be appreciated that the customer may be associated with a different financial institution but may still be able to use the device.

At block 304, a card is inserted into a card reader associated with the device. The customer may insert the card. This insertion may be required to begin interaction, such as a login, with the device in order to conduct a transaction. The login may require the insertion of a card into the card reader. It should be understood that there are a variety of ways to log into the device and many of these login methods are cardless. However, embodiments described herein will focus on the use of a card. The financial transaction device as described above may be capable of supporting by card and cardless type logins using different systems and methods.

At block 306, the type of card is determined. The card may be determined to be either a magnetic stripe only card or a EMV card. The determination is made based on information read from the magnetic stripe of the card.

At block 308, the card remains in the card reader. In some embodiments, if the customer understands the need to leave the EMV card in the reader during the transaction, the EMV card may be left in the reader. Upon determination of the card type, the financial transaction device may clamp on the card and establish a connection therewith without the customer being required to remove and reinsert the card.

In other embodiments, the financial transaction device may be configured to clamp and hold all inserted cards at the first interaction. Thus, no removal of the card is required or possible. Upon determination that the card is a magnetic stripe only card, the customer may be allowed to remove the card for the remainder of the transaction. This embodiment may be used for EMV cards that lack a magnetic stripe. Upon insertion of such a card, the card reader may detect the absence of the magnetic stripe and then search for the presence of the chip. Upon determining that the chip is present, the card may be clamped.

In some embodiments, the clamping may occur after a period of time following the insertion. For example, the card may remain in the reader for a period of time following the initial insertion. The customer may leave the card in place since they know it is an EMV card or they know not to remove the card or they leave the card inserted. The financial transaction device may then clamp the card. The period of time prior to the clamping may be a short period time, such as, for example, one or two or three or four or five seconds. Fractions of seconds may be used. Other periods of time may be set. The clamping may be for a short period of time. For example, the clamping may occur for a second or two or a fraction thereof during the processing. Other periods of time may be required.

In some embodiments, the card may be removed prior to the clamping being initiated. The financial transaction device may present an error message to the customer and ask for reinsertion of the card. In other embodiments, the transaction may continue, particularly if the card is determined to be non-EMV and the needed information was read from the card. If the card is an EMV card, the customer may be asked to reinsert the card as described above.

At block 310, upon a determination that a non-EMV card was inserted, an indication is provided that the card can be removed. The request may be made using a visual message displayed on the device. An audible message may be used in addition to or in place of the visual message. If the card was an EMV card, then the method would go to block 314 directly.

At block 312, the card is removed from the card reader. The card may be removed by the customer. In some embodiments, the card may be left in place with no effect on the transaction (for a non-EMV type card).

At block 314, the customer uses the device. The device may be used through a set of menu options for performing various actions. For example, the customer may use the device to conduct one or more financial transactions, such as, but not limited to, a deposit or cash withdrawal. A variety of other transactions may be performed as appreciated by one of ordinary skill in the art.

At block 316, the customer logs out of the device. The customer may indicate that he or she wished to conduct more transactions. The EMV card is released upon log out and/or termination of the transaction. The customer may be presented with a message that the card can be removed. The message may be visual and/or audible.

It should be appreciated that the customer may continue to conduct one or more further transactions prior to logging out of the device. In the event of further transactions, the method 200 may be repeated from block 216 above.

Figure 4:
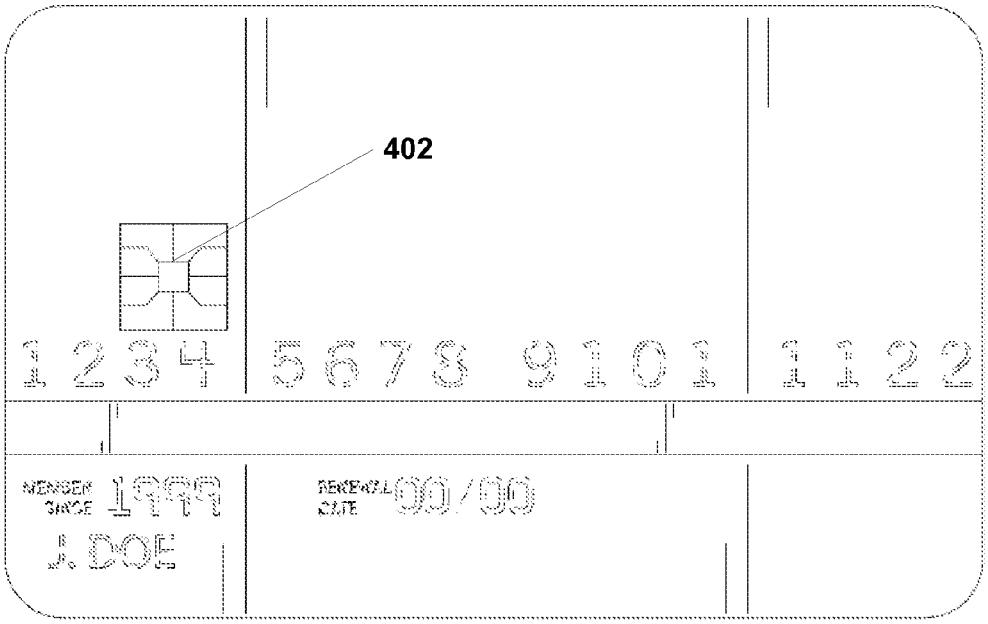
FIG. 4 is an example of an EMV card in accordance with an exemplary embodiment.

FIG. 4 depicts a front face of an EMV card in accordance with exemplary embodiments. This EMV card depiction is meant to be exemplary and non-limiting. On the front face of the card 400, the integrated circuit chip 402 can be seen. The chip 402 is embedded in the card.

Figure 5:
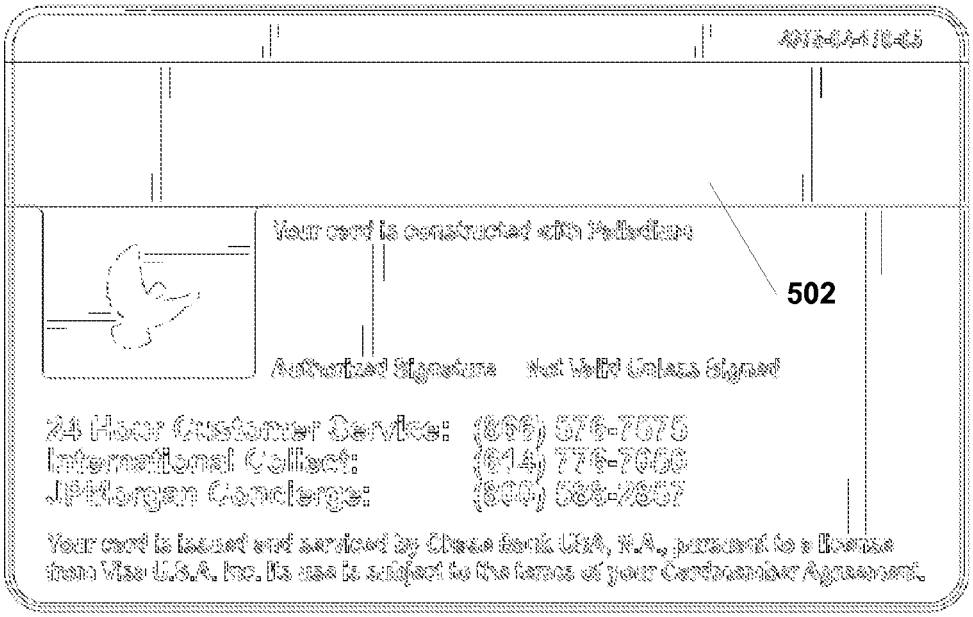
FIG. 5 is an example of a card magnetic stripe in accordance with an exemplary embodiment.
Figure 6:
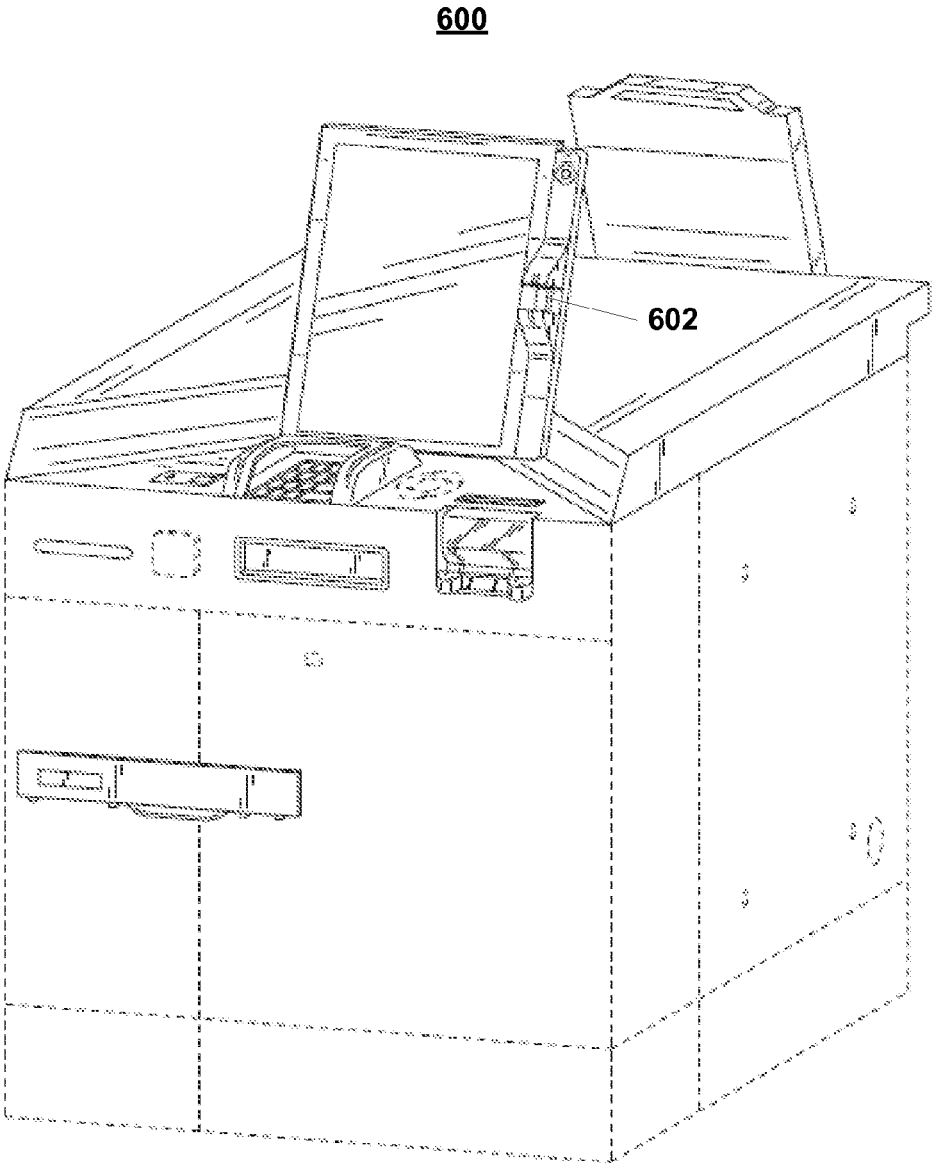
FIG. 6 is an embodiment of a financial transaction device in accordance with an exemplary embodiment.
Figure 7:
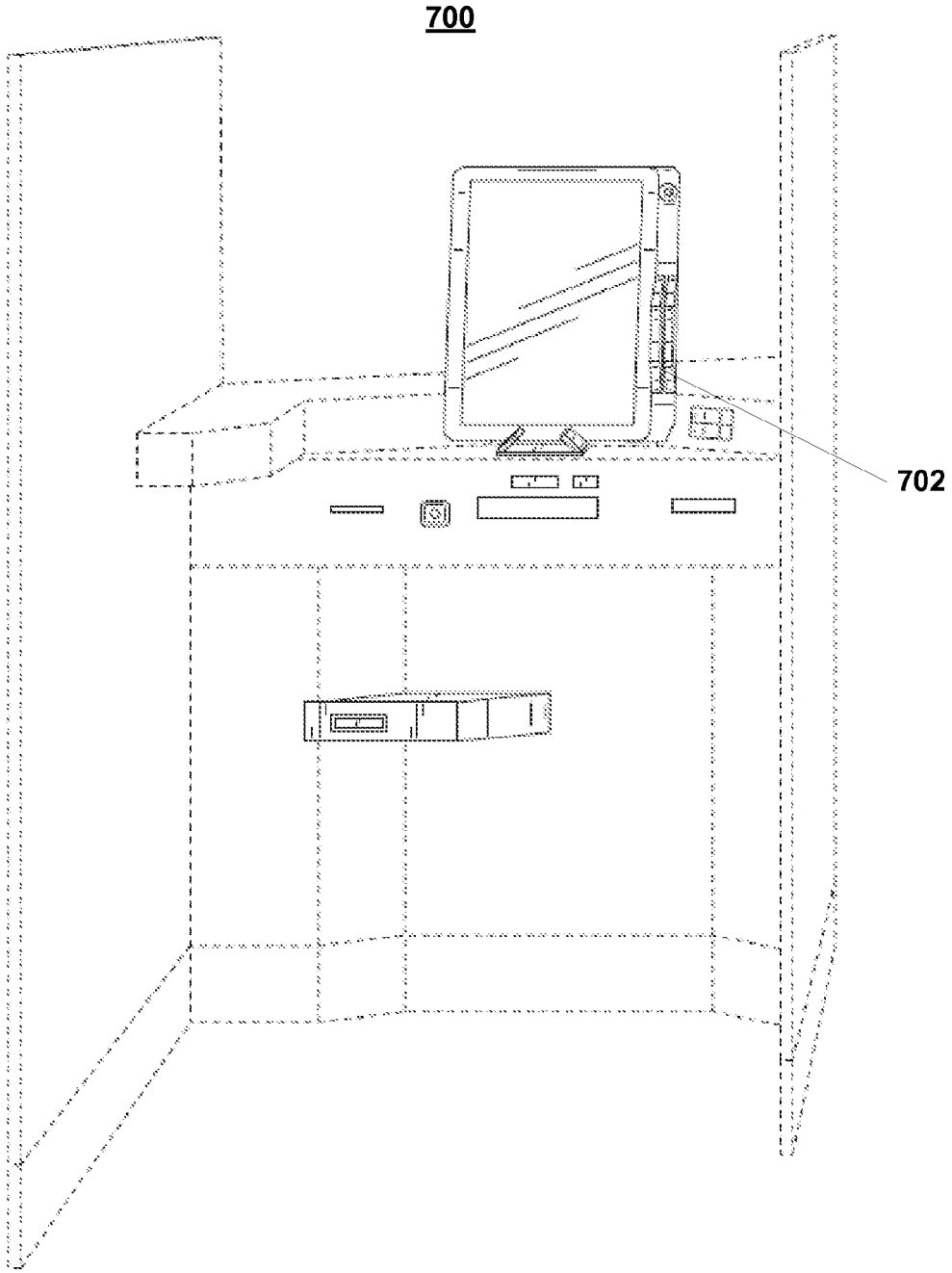
FIG. 7 is another embodiment of a financial transaction device in accordance with an exemplary embodiment.
Figure 8:
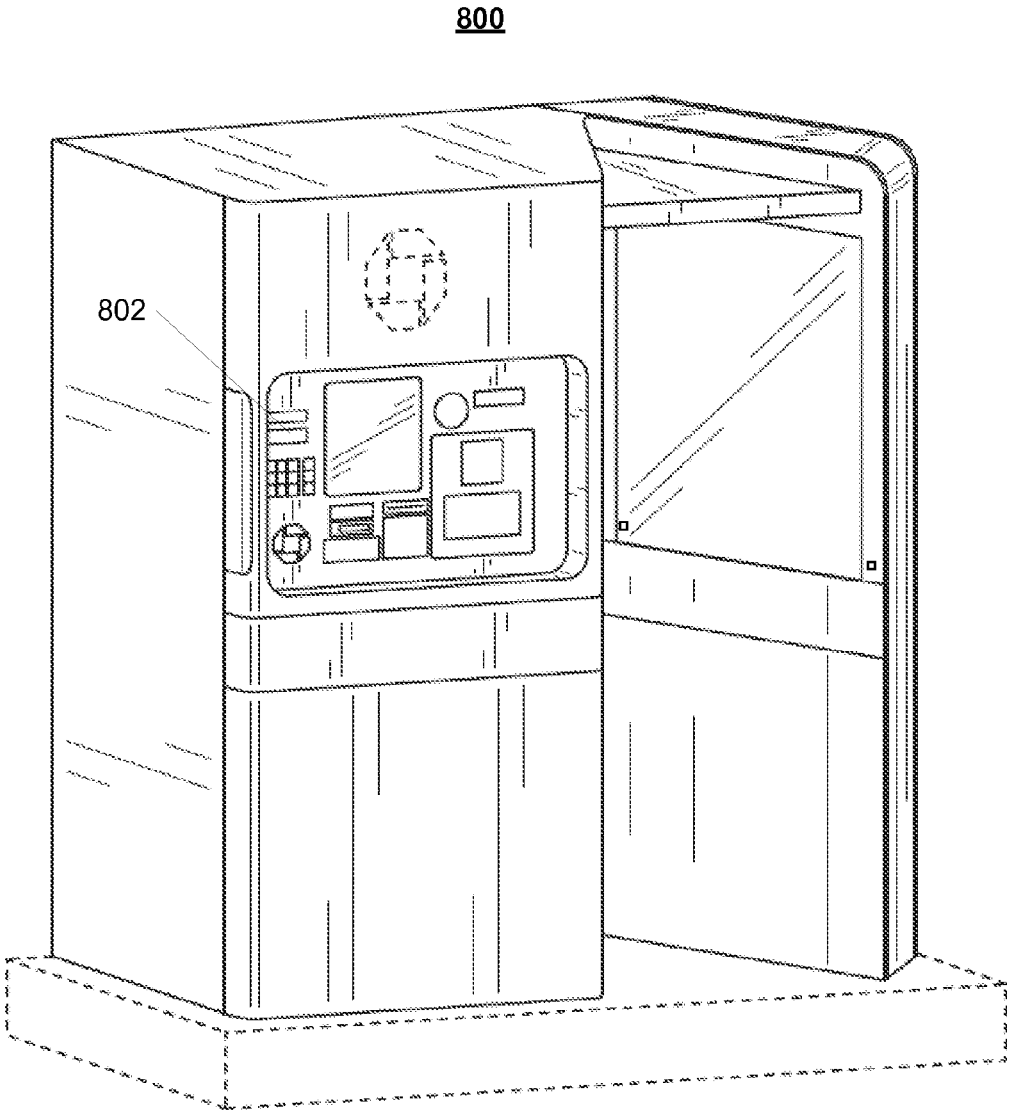
FIG. 8 is another embodiment of a financial transaction device in accordance with an exemplary embodiment.
Figure 9:
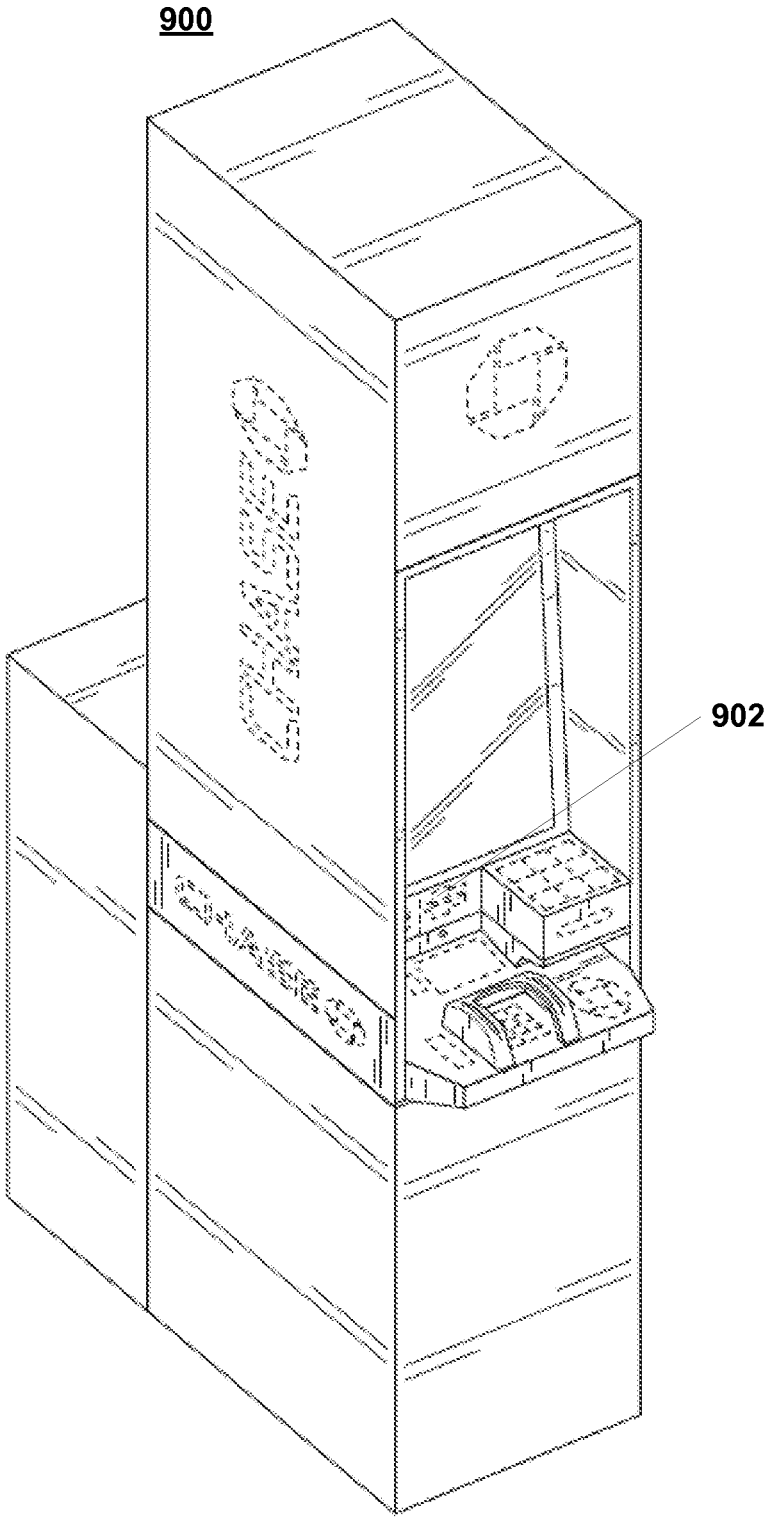
FIG. 9 is another embodiment of a financial transaction device in accordance with an exemplary embodiment.

FIG. 5 depicts a rear face of a card in accordance with exemplary embodiments. This card may be either an EMV card or a non-EMV card, such as a magnetic stripe only card. This card depiction is meant to be exemplary and non-limiting. The card 500 has a magnetic stripe 502. The magnetic stripe 502 may contain a number of tracks. Written to these tracks may be a variety of account data as well as information pertaining to the card type. A card reader as described above may read this data and process it. The data may then be used to determine the card type.

FIGS. 6 through 9 depict embodiments of various financial transaction devices according to exemplary embodiments. These embodiments are meant to be exemplary and non-limiting as a variety of different financial transaction devices may be used with the systems and methods described herein. Each financial transaction device 600, 700, 800, and 900 has a card reader 602, 702, 802, and 902 respectively. The various embodiments depict different types of card readers and different locations for these card readers on various financial transaction devices. The card reader may be capable of reading a magnetic stripe on both EMV and non-EMV cards. The card reader may also be capable of clamping and holding an EMV card for the duration of the transaction. The card reader may contain appropriate contacts to facilitate this clamping and provide for an interface with the chip on the EMV card to read/write data during the transaction.

Hereinafter, aspects of implementation of the inventions will be described. As described above, the method of the invention may be computer implemented as a system. The system of the invention or portions of the system of the invention may be in the form of a "processing machine," for example. As used herein, the term "processing machine" is to be understood to include at least one processor that uses at least one memory. The at least one memory stores a set of instructions. The instructions may be either permanently or temporarily stored in the memory or memories of the processing machine. The processor executes the instructions that are stored in the memory or memories in order to process data. The set of instructions may include various instructions that perform a particular task or tasks, such as those tasks described above in the flowcharts. Such a set of instructions for performing a particular task may be characterized as a program, software program, or simply software.

The description of exemplary embodiments describes servers, portable electronic devices, and other computing devices that may include one or more modules, some of which are explicitly depicted in the figures, others are not. As used herein, the term "module" may be understood to refer to executable software, firmware, hardware, and/or various combinations thereof. It is noted that the modules are exemplary. The modules may be combined, integrated, separated, and/or duplicated to support various applications. Also, a function described herein as being performed at a particular module may be performed at one or more other modules and/or by one or more other devices (e.g., servers) instead of or in addition to the function performed at the particular module. Further, the modules may be implemented across multiple devices and/or other components local or remote to one another. Additionally, the modules may be moved from one device and added to another device, and/or may be included in both devices. It is further noted that the software described herein may be tangibly embodied in one or more physical media, such as, but not limited to, a compact disc (CD), a digital versatile disc (DVD), a floppy disk, a hard drive, read only memory (ROM), random access memory (RAM), as well as other physical media capable of storing software, and/or combinations thereof. Moreover, the figures illustrate various components (e.g., servers, portable electronic devices, client devices, computers, etc.) separately. The functions described as being performed at various components may be performed at other components, and the various components may be combined and/or separated. Other modifications also may be made.

According to exemplary embodiments, the systems and methods may be computer implemented using one or more computers, incorporating computer processors. The computer implementation may include a combination of software and hardware. The computers may communicate over a computer based network. The computers may have software installed thereon configured to execute the methods of the exemplary embodiments. The software may be in the form of modules designed to cause a computer processor to execute specific tasks. The computers may be configured with hardware to execute specific tasks. As should be appreciated, a variety of computer based configurations are possible.

The processing machine described above may also utilize any of a wide variety of other technologies including a special purpose computer, a computer system including a microcomputer, mini-computer or mainframe for example, a programmed microprocessor, a micro-controller, a PICE (peripheral integrated circuit element), a CSIC (Customer Specific Integrated Circuit) or ASIC (Application Specific Integrated Circuit) or other integrated circuit, a logic circuit, a digital signal processor, a programmable logic device such as a FPGA, PLD, PLA or PAL, or any other device or arrangement of devices for example capable of implementing the steps of the process of the invention.

It is appreciated that in order to practice the method of the invention as described above, it is not necessary that the processors and/or the memories of the processing machine be physically located in the same geographical place. For example, each of the processors and the memories and the data stores used in the invention may be located in geographically distinct locations and connected so as to communicate in any suitable manner. Additionally, it is appreciated that each of the processor and/or the memory and/or data stores may be composed of different physical pieces of equipment. Accordingly, it is not necessary that the processor be one single piece of equipment in one location and that the memory be another single piece of equipment in another location. For example, it is contemplated that the processor may be two or more pieces of equipment in two or more different physical locations. These two or more distinct pieces of equipment may be connected in any suitable manner. Additionally, the memory may include two or more portions of memory in two or more physical locations. Additionally, the data storage may include two or more components or two or more portions of memory in two or more physical locations.

To explain further, processing as described above is performed by various components and various memories. However, it is appreciated that the processing performed by two distinct components as described above may, in accordance with a further embodiment of the invention, be performed by a single component. Further, the processing performed by one distinct component as described above may be performed by two distinct components. In a similar manner, the memory storage performed by two distinct memory portions as described above may, in accordance with a further embodiment of the invention, be performed by a single memory portion. Further, the memory storage performed by one distinct memory portion as described above may be performed by two memory portions. It is also appreciated that the data storage performed by two distinct components as described above may, in accordance with a further embodiment of the invention, be performed by a single component. Further, the data storage performed by one distinct component as described above may be performed by two distinct components.

Further, various technologies may be used to provide communication between the various processors and/or memories, as well as to allow the processors and/or the memories of the invention to communicate with any other entity; e.g., so as to obtain further instructions or to access and use remote memory stores, for example. Such technologies used to provide such communication might include a network, such as a computer network, for example, the Internet, Intranet, Extranet, LAN, or any client server system that provides communication of any capacity or bandwidth, for example. Such communications technologies may use any suitable protocol such as TCP/IP, UDP, or OSI, for example. It should be appreciated that examples of computer networks used in the preceding description of exemplary embodiments, such as the Internet, are meant to be non-limiting and exemplary in nature.

As described above, a set of instructions is used in the processing of the invention. The set of instructions may be in the form of a program or software. The software may be in the form of system software or application software, for example. The software might also be in the form of a collection of separate programs, a program module within a larger program, or a portion of a program module, for example. The software used might also include modular programming in the form of object oriented programming or any other suitable programming form. The software tells the processing machine what to do with the data being processed.

Further, it is appreciated that the instructions or set of instructions used in the implementation and operation of the invention may be in a suitable form such that the processing machine may read the instructions. For example, the instructions that form a program may be in the form of a suitable programming language, which is converted to machine language or object code to allow the processor or processors to read the instructions. For example, written lines of programming code or source code, in a particular programming language, are converted to machine language using a compiler, assembler or interpreter. The machine language is binary coded machine instructions that are specific to a particular type of processing machine, e.g., to a particular type of computer, for example. The computer understands the machine language.

Any suitable programming language may be used in accordance with the various embodiments of the invention. Illustratively, the programming language used may include assembly language, Ada, APL, Basic, C, C++, C#, COBOL, dBase, Forth, Fortran, Java, Modula-2, Pascal, Prolog, Python, RUM Ruby, Visual Basic, and/or JavaScript, for example. Further, it is not necessary that a single type of instructions or single programming language be utilized in conjunction with the operation of the system and method of the invention. Rather, any number of different programming languages may be utilized as is necessary or desirable.

Also, the instructions and/or data used in the practice of the invention may utilize any compression or encryption technique or algorithm, as may be desired. An encryption module might be used to encrypt data. Further, files or other data may be decrypted using a suitable decryption module, for example.

As described above, the invention may illustratively be embodied in the form of a processing machine, including a computer or computer system, for example, that includes at least one memory. It is to be appreciated that the set of instructions, e.g., the software for example, that enables the computer operating system to perform the operations described above may be contained on any of a wide variety of computer readable media, as desired. Further, the data for example processed by the set of instructions might also be contained on any of a wide variety of media or medium. For example, the particular medium, e.g., the memory in the processing machine, utilized to hold the set of instructions and/or the data used in the invention may take on any of a variety of physical forms or transmissions, for example. Illustratively, the medium may be in the form of paper, paper transparencies, a compact disk, a DVD, an integrated circuit, a hard disk, a floppy disk, an optical disk, a magnetic tape, a RAM, a ROM, a PROM, a EPROM, a wire, a cable, a fiber, communications channel, a satellite transmissions or other remote transmission, as well as any other medium or source of data that may be read by the processors of the invention.

Further, the memory or memories used in the processing machine that implements the invention may be in any of a wide variety of forms to allow the memory to hold instructions, data, or other information, as is desired. Thus, the memory might be in the form of a database to hold data. The database might use any desired arrangement of files such as a flat file arrangement or a relational database arrangement, for example.

In the system and method of the invention, a variety of "user interfaces" may be utilized to allow a user to interface with the processing machine or machines that are used to implement the invention. As used herein, a user interface includes any hardware, software, or combination of hardware and software used by the processing machine that allows a user to interact with the processing machine. A user interface may be in the form of a dialogue screen for example. A user interface may also include any of a mouse, touch screen, keyboard, voice reader, voice recognizer, dialogue screen, menu box, list, checkbox, toggle switch, a pushbutton or any other device that allows a user to receive information regarding the operation of the processing machine as it processes a set of instructions and/or provide the processing machine with information. Accordingly, the user interface is any device that provides communication between a user and a processing machine. The information provided by the user to the processing machine through the user interface may be in the form of a command, a selection of data, or some other input, for example.

As discussed above, a user interface is utilized by the processing machine that performs a set of instructions such that the processing machine processes data for a user. The user interface is typically used by the processing machine for interacting with a user either to convey information or receive information from the user. However, it should be appreciated that in accordance with some embodiments of the system and method of the invention, it is not necessary that a human user actually interact with a user interface used by the processing machine of the invention. Rather, it is contemplated that the user interface of the invention might interact, e.g., convey and receive information, with another processing machine, rather than a human user. Accordingly, the other processing machine might be characterized as a user. Further, it is contemplated that a user interface utilized in the system and method of the invention may interact partially with another processing machine or processing machines, while also interacting partially with a human user.

While the embodiments have been particularly shown and described within the framework of financial services devices, it will be appreciated that variations and modifications may be effected by a person of ordinary skill in the art without departing from the scope of the invention. Furthermore, one of ordinary skill in the art will recognize that such processes and systems do not need to be restricted to the specific embodiments described herein. Other embodiments, combinations of the present embodiments, and uses and advantages of the present invention will be apparent to those skilled in the art from consideration of the specification and practice of the invention disclosed herein. The specification and examples should be considered exemplary.

What is claimed is:

1. A computer implemented method comprising:

receiving, electronically from a card reader, information read from a magnetic stripe associated with a card at a financial transaction device, wherein the card is inserted into card reader and then withdrawn;

processing, by a computer processor, the information to determined whether the card is a non-EMV card or an EMV card;

determining, by a computer processor, the card is an EMV card;

providing, electronically, a message requesting the card be reinserted into the card reader after determining the card is an EMV card; and upon reinsertion of the card, clamping the card into the card reader during a time that a transaction is conducted at the financial transaction device.

2. The computer implemented method of claim 1, further comprising:

determining, by the computer processor, that the card is a magnetic stripe only card, such that the card is not required to be reinserted during the transaction conducted at the financial transaction device.

3. The computer implemented method of claim 1, wherein the financial transaction device is an automated teller machine.

4. A computer implemented method, comprising:

receiving, electronically, indication of an insertion a card into a card reader associated with a financial transaction device;

upon detection of the insertion, clamping the card by the card reader such that the card cannot be removed;

reading, electronically by the card reader, information from magnetic stripe associated with the card;

processing, by a computer processor, the information to determine whether the card is a non-EMV card or an EMV card;

determining, by the computer processor, the card is an EMV card; and after the determining, maintaining the clamping on the card during a time that a transaction is conducted at the financial transaction device.

5. The computer implemented method of claim 4, further comprising:

determining, by the computer processor, the card is a magnetic stripe only card;

releasing the clamping on the card; and providing, electronically, a message indicating the card can be withdrawn from the card reader.

6. The computer implemented method of claim 4, wherein the financial transaction device is an automated teller machine.

7. A system, comprising:

a processor; and a memory comprising computer-readable instructions which when executed by the processor cause the processor to perform the steps comprising:

receiving, from a card reader, information magnetic stripe associated with a card at a financial transaction device, wherein the card is inserted into the card reader and then withdrawn;

processing the information to determine whether the card is a non-EMV card or an EMV card;

determining that the card is an EMV card;

providing a message requesting the card be reinserted into the card reader following the determining that the card is an EMV card; and causing, upon reinsertion of the card, a clamping of the card by the card reader during a time that a transaction is conducted at the financial transaction device.

8. The system of claim 7, further comprising:

determining that the card is a magnetic stripe only card, such that the card is not required to be reinserted during the transaction.

9. The system of claim 7, wherein the financial transaction device is an automated teller machine.

10. A system comprising:

a processor; and a memory comprising computer-readable instructions which when executed by the processor cause the processor to perform the steps comprising:

receiving indication of an insertion of a card into a card reader associated with a financial transaction device;

upon detection of the insertion, causing a clamping of the card by the card reader such that the card cannot be removed;

receiving, from a card reader, information from a magnetic stripe associated with a card at a financial transaction device;

processing the information to determine whether the card is a non-EMV card or an EMV card;

determining that the card is an EMV card; and causing the maintaining of the clamping on the card, after determining the card is an EMV card, during a time that a transaction is conducted at the financial transaction device.

11. The system of claim 10, further comprising:

determining that the card is a magnetic stripe only card;

causing releasing of the clamping on the card; and providing a message indicating the card can be withdrawn from the card reader.

12. The system of claim 10, wherein the financial transaction device is an automated teller machine.

* * * * *